United States Patent [19]

Falk et al.

[11] Patent Number: 4,600,121

[45] Date of Patent: Jul. 15, 1986

[54] ARTICLE VENDOR

[75] Inventors: Leonard P. Falk, Florissant; Robert L. Stadler, Overland, both of Mo.

[73] Assignee: UniDynamics Corporation, Stamford, Conn.

[21] Appl. No.: 658,605

[22] Filed: Oct. 9, 1984

[51] Int. Cl.[4] ..... G07F 11/42

[52] U.S. Cl. ..... 221/130; 221/131; 221/133; 221/195

[58] Field of Search ..... 221/124, 123, 195, 191, 221/133, 92, 88, 87, 69, 224, 226, 258, 279, 130, 131; 312/35, 72, 42, 71

[56] References Cited

U.S. PATENT DOCUMENTS

| | | | |
|---|---|---|---|
| 874,236 | 12/1907 | Pond | 221/117 |
| 963,245 | 6/1910 | Parkhurst | 221/39 |
| 3,000,539 | 9/1961 | Danziger et al. | 221/195 X |
| 3,190,489 | 6/1965 | Childers et al. | 221/130 X |
| 3,282,466 | 11/1966 | Meresz et al. | 221/133 X |
| 3,348,732 | 10/1967 | Schwarz | 221/123 |
| 3,722,745 | 3/1973 | Gushi et al. | 221/195 X |
| 3,893,589 | 7/1975 | Mandell | 221/123 |
| 3,908,859 | 9/1975 | Hohmann | 221/279 X |
| 4,032,039 | 6/1977 | Schuller | 221/75 |
| 4,155,484 | 5/1979 | Pastore | 221/35 |
| 4,301,909 | 12/1981 | Snavely | 194/2 |

FOREIGN PATENT DOCUMENTS

| | | | |
|---|---|---|---|
| 1088684 | 10/1967 | United Kingdom | 221/226 |

*Primary Examiner*—Joseph J. Rolla
*Assistant Examiner*—David H. Bollinger
*Attorney, Agent, or Firm*—Senniger, Powers, Leavitt and Roedel

[57] ABSTRACT

An article vendor comprising a cabinet having a front and a rear and left and right sides, front and rear banks of article holding magazines with each bank having a plurality of the magazines arranged in banks with the magazines extending horizontally one above another from adjacent one side of the cabinet to adjacent the other, each magazine being adapted to hold articles to be vended in a first horizontal row for being dispensed from the left end of the magazine and in the second horizontal row for being dispensed from the right end of the magazine, each magazine in the front bank being constructed for ejection of articles at the left and right ends thereof toward the front and each magazine in the rear bank being constructed for ejection of articles at the left and right ends thereof towards the rear. A constant force spring biases each row of articles in each magazine toward the respective ends of the magazine and an ejection mechanism is provided at each end of the left and right banks of the magazines for selectively dispensing the end articles in the magazines.

17 Claims, 22 Drawing Figures

ARTICLE VENDOR

BACKGROUND OF THE INVENTION

1. Field of the Invention

The present invention relates to article vendors, and more particularly, to such vendors having multiple magazine dispensers which dispense articles from an end thereof.

2. Prior Art

The present invention is particularly useful as a cigarette, or similar article dispensing apparatus. There has been a considerable increase in the brands of cigarettes available to the public over what there used to be in the recent past. Also, many of the brands are offered in different lengths which further increases the choices available. Because of this increased number of cigarette types and choices of packaging, existing cigarette dispensing apparatus generally do not hold a large enough variety of these items to cover the desired choices of a significant number of customers.

Conventional cigarette vending apparatus, or the like, generally dispense from a plurality of vertical columns in such a way that the lowermost package drops by gravity into a chute which takes it to a delivery station where it can be accessed by a customer. This arrangement generally limits the number of columns which can be contained within a standard cabinet size and thus limits the selections available to a customer.

SUMMARY OF THE INVENTION

The present invention overcomes the above-described difficulties and disadvantages associated with the prior art devices by providing an article vendor in which a plurality of magazines are mounted in banks in a cabinet and are provided with means for urging two different groups of the articles in each magazine towards opposite ends of the magazine where they are individually dispensed and supplied to a delivery station where they can be recovered by a customer. The means for urging the articles towards opposite ends of each magazine are such that different amounts of two different types of articles can be positioned on opposite ends of a magazine. Thus, if one type is more in demand than another, the numbers of the two articles can be adjusted so that the more popular one takes up more of the magazine than the less popular one.

In a preferred form the magazines are disposed horizontally and are mounted one above the other in banks. Ejector mechanisms are mounted in the cabinet at each end of the magazines for ejecting a selected article from one of the magazines so that it will drop to the delivery station. Control means are provided and associated with a selection means from which the customer can make a selection of a desired article and cause an ejector mechanism to move to the location of that article on the proper magazine and cause it to eject the article.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION OF THE PREFERRED EMBODIMENT

Figure 1:
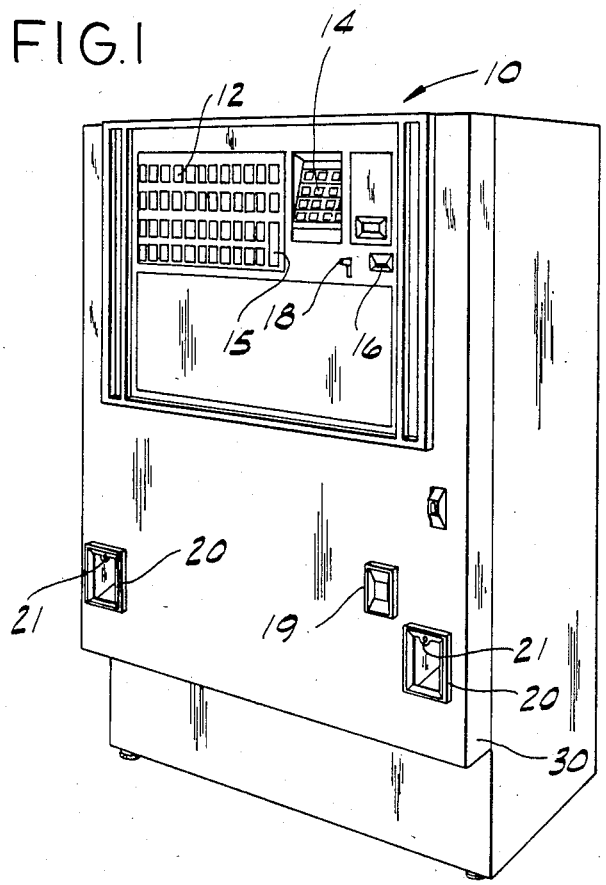
FIG. 1 is a pictorial view of a cigarette vending apparatus in which the preferred embodiment of the present invention is utilized.

The article vendor of the present invention is illustrated in the preferred embodiment as a cigarette vending machine 10, as shown in FIG. 1, which generally has conventional features including a plurality of cigarette package displays 12 which illustrate the various types of cigarettes available from the machine, a selection keyboard 14 which, through an alphanumeric system is associated with each of the cigarette image displays 12 so that a proper selection can be made, a "sold out" sign 15 which is illuminated when a selected article is sold out or the machine is malfunctioning, a coin insert and accept mechanism 16, a coin return switch 18, coin return station 19 and cigarette delivery stations 20. It should be noted that although a single delivery station is conventional, the construction of the preferred embodiment of the present invention preferably utilizes the two stations 20.

Figure 3:
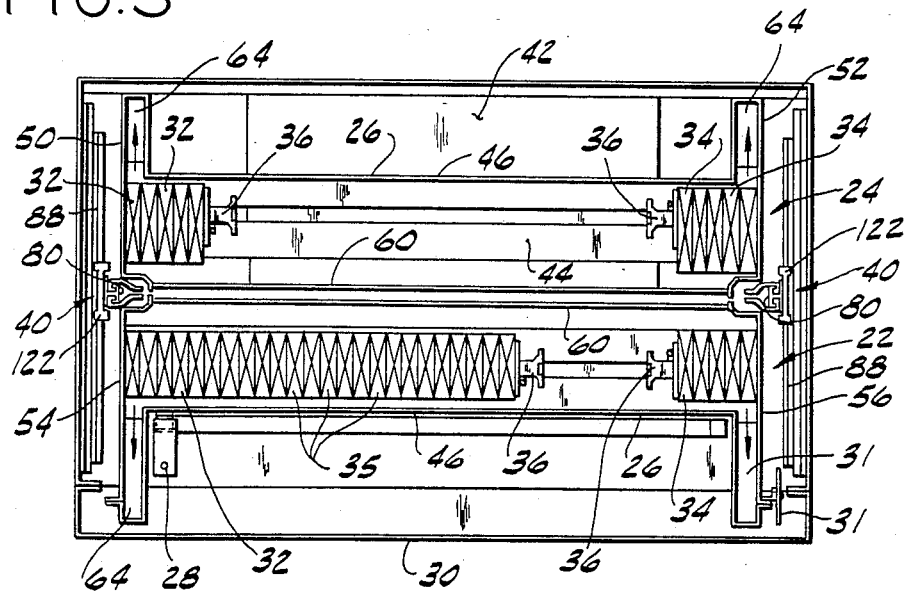
FIG. 3 is a plan view of the embodiment of FIG. 1 with the upper sheet metal top of the cabinet removed.
Figure 2:
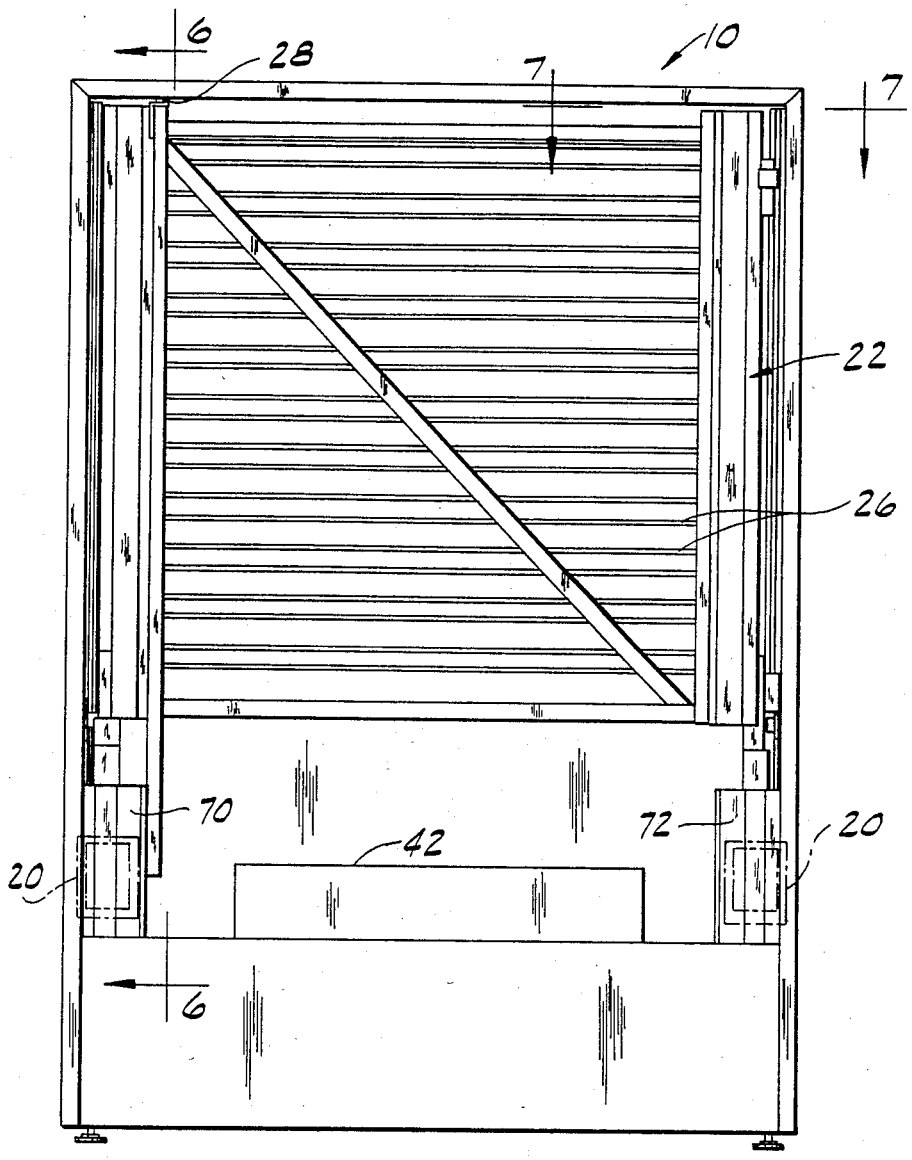
FIG. 2 is a front elevational view with the front door of the cabinet removed.
Figure 4:
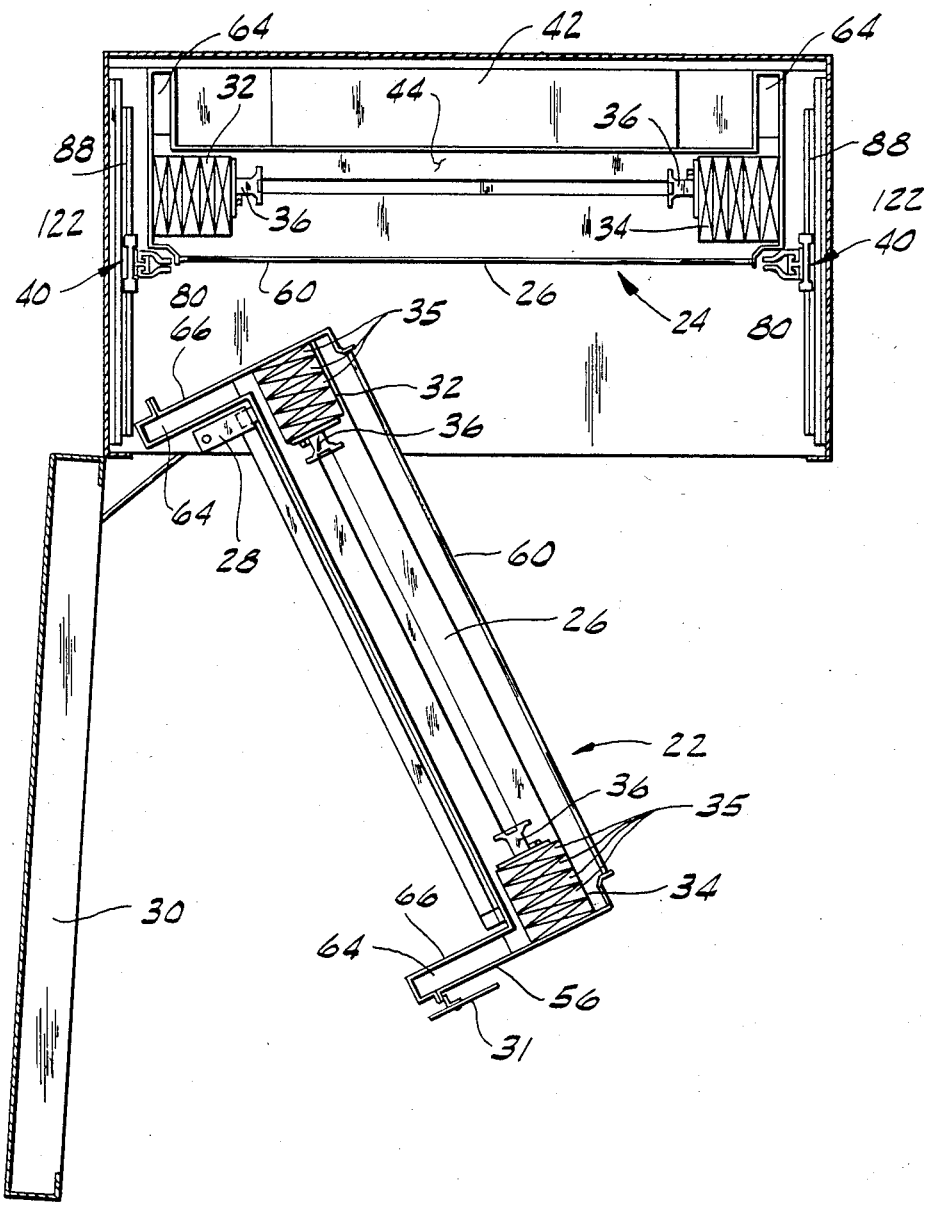
FIG. 4 is a plan view similar to FIG. 3, with the door open and the front bank of magazines swung out for access to the interior of the cabinet.

As seen in FIGS. 2–5 the cigarette machine 10 includes two banks 22 and 24 of horizontally positioned magazines 26 stacked one above another. The front bank 22 of 12 magazines 26 is hinged at 28 to be swung outwardly for filling the magazines 26 when the front door 30 of the cigarette machine cabinet is opened, as shown in FIG. 4. A latch 31 is pivotally mounted to front bank 22 and hooks onto a bracket on the side of the cabinet to hold the front bank in position during use.

The rear bank 24 of 11 magazines 26 is fixedly mounted against the rear wall of the cabinet and can be loaded when the front bank 22 is pivoted outwardly. The total of 23 magazines 26 thus permits 46 different selections of cigarette brands to be placed in the machine 10 of the preferred embodiment, although a greater or lesser number of magazines may be included in the design, as desired.

As seen in FIG. 3, each of the magazines 26 can be loaded at the left and right ends with separate stacks 32, 34 of cigarette packs 35 which are positioned on their side edges in the magazines. All of the cigarette packs 35 within a stack, for example stack 32, are the same brand, however, stacks 32 and 34 on the same magazine 26 can each contain a different brand. This versatility provides the ability to increase the volume of a particular brand of cigarettes by placing one brand at both ends of a magazine 26 and/or on multiple magazines 26, or provides variety by permitting different brands to be placed at each end of each magazine 26. Also, the volume of one stack, for example a stack 32 as seen in FIG. 3, can extend for substantially the majority of the length of a magazine 26 while the volume of a less often selected brand can be placed in a stack 34 in the same magazine 26, thus utilizing the maximum amount of space within each magazine while adjusting the volumes of particular brands for customer preferences.

Each of the stacks 32 and 34 of cigarette packs 35 is biased towards its respective left or right end of each magazine 26 by a biasing member 36 (FIG. 3) which is urged by a biasing spring 38 (FIG. 9) towards its associated end of each magazine 26. Each magazine 26 holds two members 36, each of which can be extended for substantially the entire extent of the magazine 26 for the desired volume adjustment of the number of packs 35 in stack 32 or 34. Member 36, because of the spring 38, engages the innermost pack of cigarettes 35 in a stack so that the packs 35 in that stack are forced against the respective left or right side wall of the magazine 26. The outermost pack 35 is the pack which is dispensed from a magazine when it is selected.

The individual cigarette packs 35 disposed at the ends of each magazine 26 are removed by an ejector mechanism, shown generally at 40 (FIG. 3), which is selectively moved to a location adjacent the end pack 35 of cigarettes on a magazine 26 and then is moved laterally to eject the desired pack 35, forwardly if from the front bank 22 of magazines 26 or rearwardly if from the rear bank 24 of magazines 26. The movement of the ejector mechanism 40 is controlled through control circuity associated therewith, which also controls the other operating functions of the vending machine 10 and which is contained in the housing 42 (FIG. 2) within the cabinet.

Figure 5:
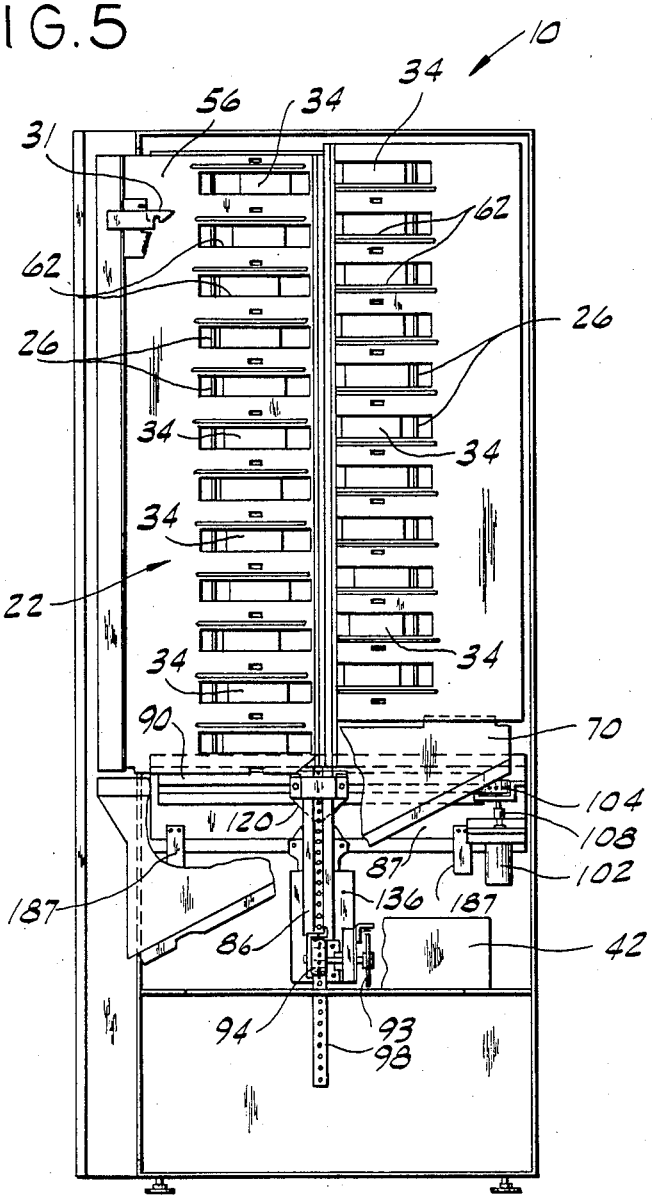
FIG. 5 is a side view of the embodiment of FIG. 1 with the sheet metal side of the cabinet removed and with the dispenser chute partially cut away, and illustrating portions of one of the ejector mechanisms mounted on the left side of the cabinet as viewed from FIG. 2.
Figure 8:
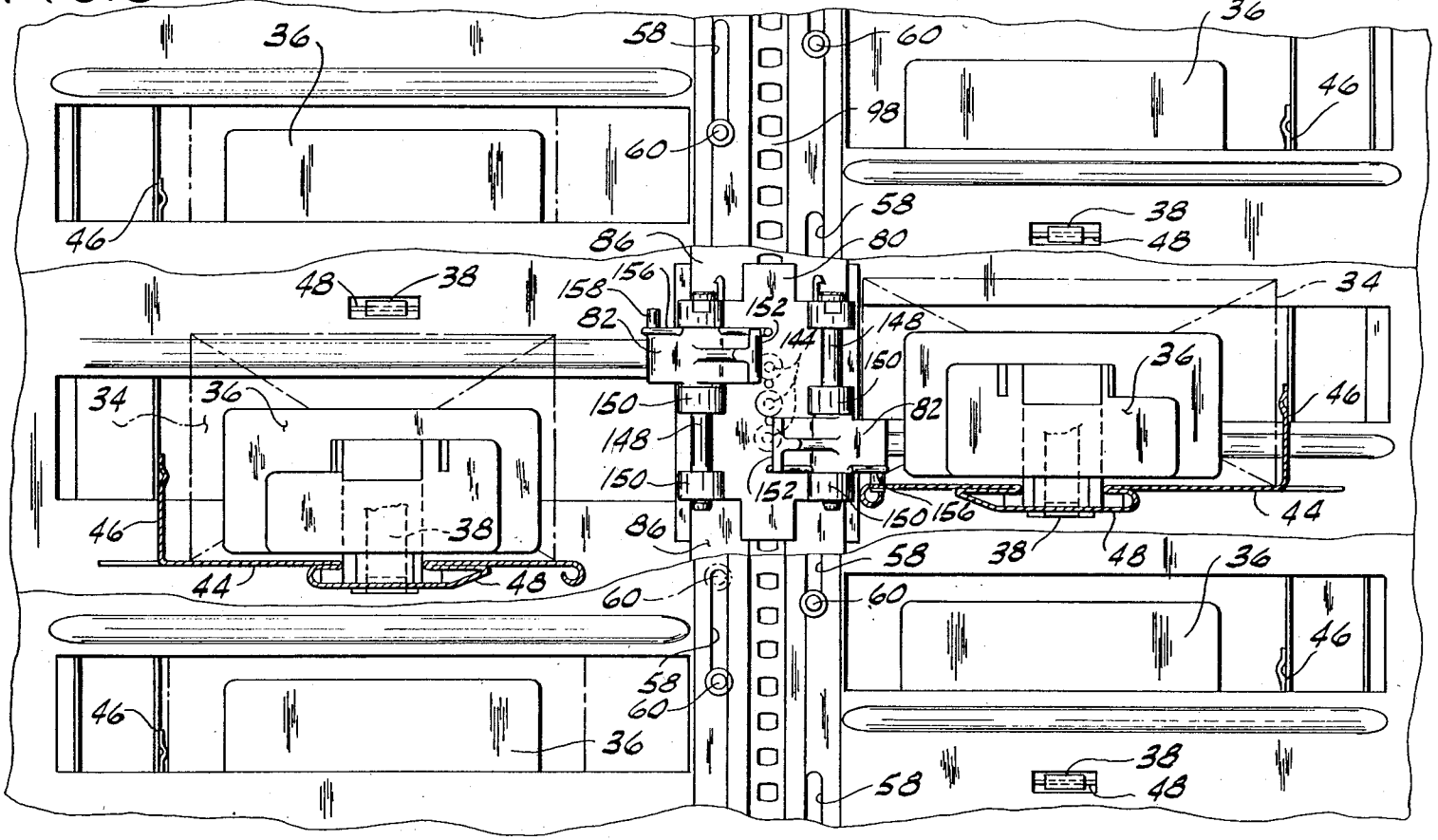
FIG. 8 is an enlarged partial cross-sectional side view looking from the right in FIG. 7, illustrating the vertical position of a portion of an ejector mechanism relative to the front and rear magazines.

Referring now to the construction of the magazines 26, each bank 22, 24 of magazines 26 is formed of a plurality of horizontal, sheet metal shelves 44 (FIG. 8) each having a vertical wall 46 extending the length of each shelf 44 and against which the bases of the cigarette packs 35 in each stack 32, 34 are set when positioned in the magazines 26, so that they are properly aligned for ejection. In the bottom of each shelf 44 is formed a contoured portion 48 which defines a channel extending the length of the each shelf 44 and into which a lower portion of slider 36 extends for guiding it. Also, the spring 38 passes through this channel beneath the packs of cigarettes 35. The ends of each shelf 44 in the rear bank 24 of magazines 26 are welded or otherwise secured to vertical sheet metal end plates 50 and 52 (FIGS. 3–5). Likewise, the shelves 44 in the front bank are welded or otherwise secured at their end portions to vertical sheet metal end plates 54 and 56. As best seen in FIG. 8, shelves 44 in front bank 22 are vertically offset from shelves 44 in rear bank 24.

The vertical end plates 50 and 52 of the rear bank 24, and vertical end plates 54 and 56 of the front bank 22 at their adjacent edges are provided with a plurality of slots 58 (FIGS. 8 and 9) positioned in alignment with each shelf 44 and each of which carries a rod 60 which can be slid up to place cigarette packs 35 on the shelves 44. Rod 60 is normally held by gravity in the bottom of the slots 58 to contain the packs 35 on the shelves 44.

Figure 9:
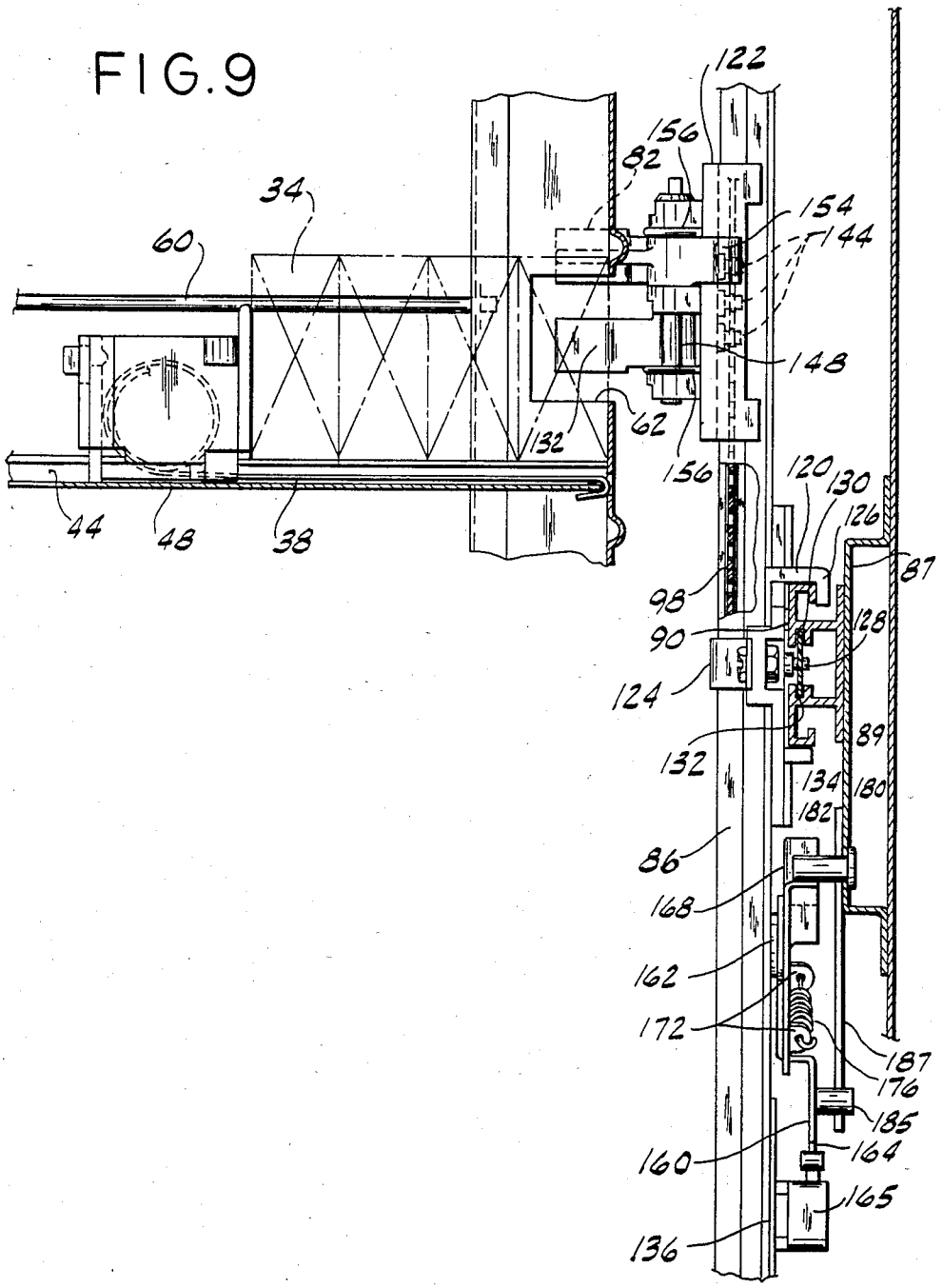
FIG. 9 is an enlarged partial cross-sectional view in the direction of line 9—9 on FIG. 7, illustrating an ejector mechanism and direction sensing mechanism of the preferred embodiment.
Figure 10:
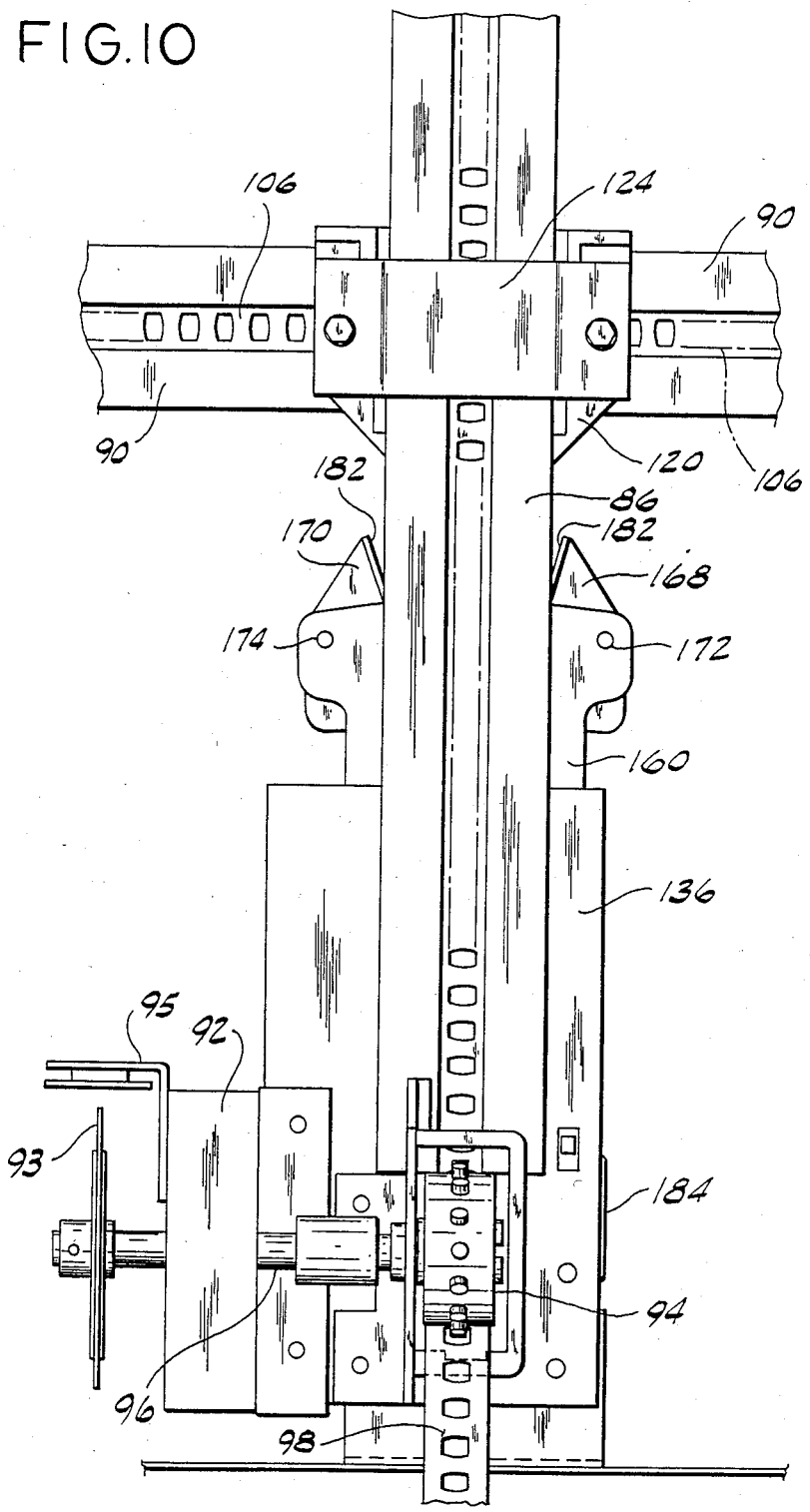
FIG. 10 is a side view of the direction sensing mechanism looking from the left as shown in FIG. 9.

As seen in FIGS. 5 and 9, each vertical end plate 50, 52, 54, 56 has a plurality of slots 62 defined therein, each adjacent a respective shelf 44. Slots 62 permit access by the ejector mechanism 40 to the endmost cigarette pack 35 in each magazine 26. As seen in FIGS. 5 and 8, slots 62 in front bank 22 are vertically offset from slots 62 in rear bank 24, in the same manner as shelves 44.

Figure 7:
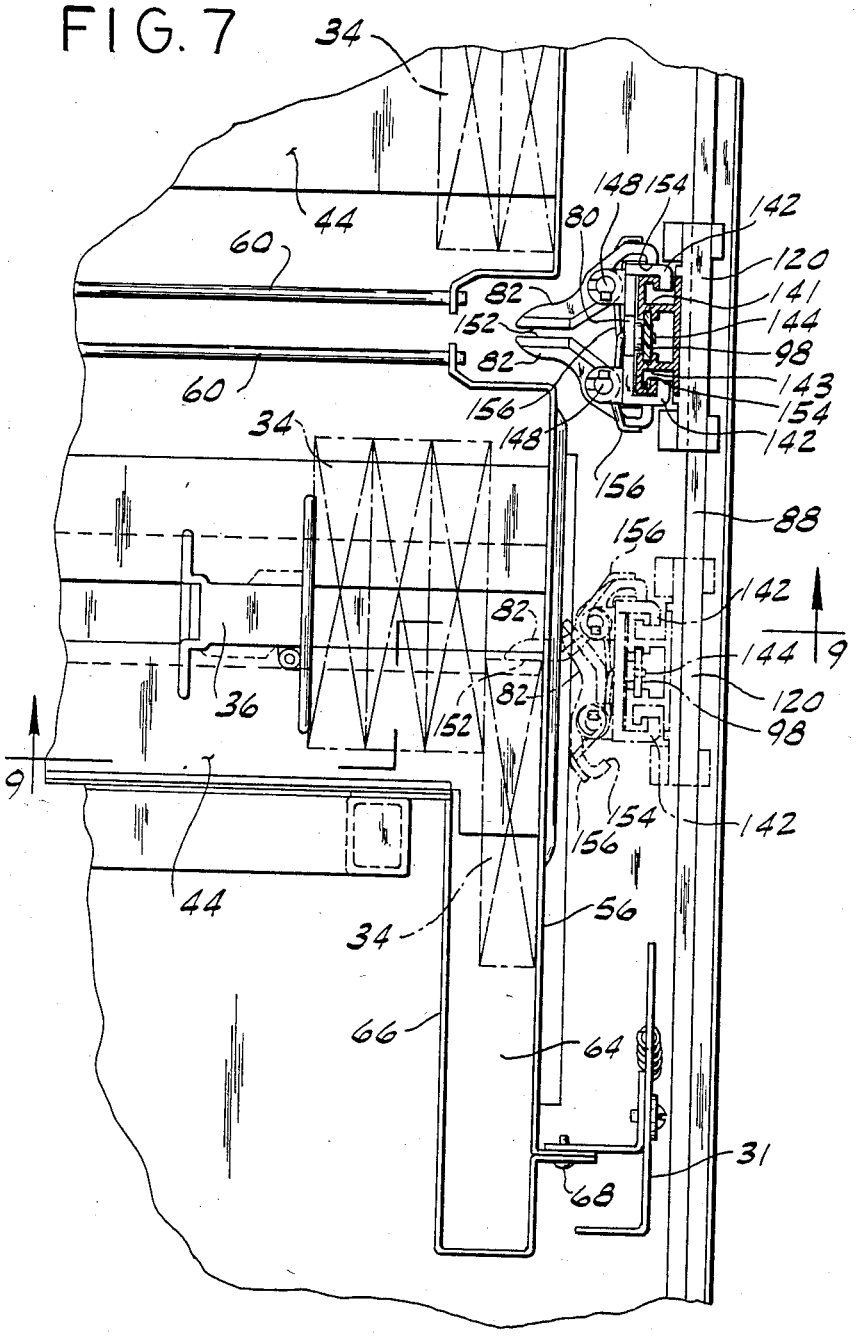
FIG. 7 is an enlarged partial cross-sectional top view in the direction of line 7—7 on FIG. 2, illustrating the position of the right side ejector mechanism in relation to the front and rear magazines and showing in phantom the ejector mechanism ejecting a pack from a front magazine.

A portion of each of the vertical end plates 50–56 forms one wall of a delivery chute 64, for example, as shown in FIG. 7 with respect to end plate 56. An inner sheet metal wall 66 is bolted as at 68 to end plate 56 so that chute 64 extends from the top magazine 26 of a bank to the bottom magazine 26 and provides an enclosed path for cigarette packs 35 to drop through once they are pushed off of a shelf 44 on which they are sitting. The chutes 64 at the left and right ends of the front bank 22 of magazines 26 extend forward towards the front of the cabinet while the chutes 64 at the left and right ends of the rear bank 24 of magazines 26 extend towards the rear wall of the cabinet.

A pair of delivery troughs 70 and 72 (FIGS. 2 and 5) are disposed, respectively, at the left and right sides of the front and rear banks 22, 24 of magazines 26 beneath the respective chutes 64 for receiving packs 35 dropped therein. The construction of troughs 70 and 72 which is substantially simlar is best seen in FIG. 5 with respect to trough 70. Trough 70 extends from the bottom of chute 64 to delivery station 20 so that packs 35 dropped from the left end of a magazine are delivered to a customer at station 20 on the left side of the cabinet and, likewise, those packs 35 dropped from the right end of a magazine are delivered to a customer at station 20 on the right side of the cabinet. So that a customer is alerted to which station 20 the pack will be delivered to, a lamp 21 is positioned above each and the appropriate one is flashed as the pack is delivered.

Figure 6:
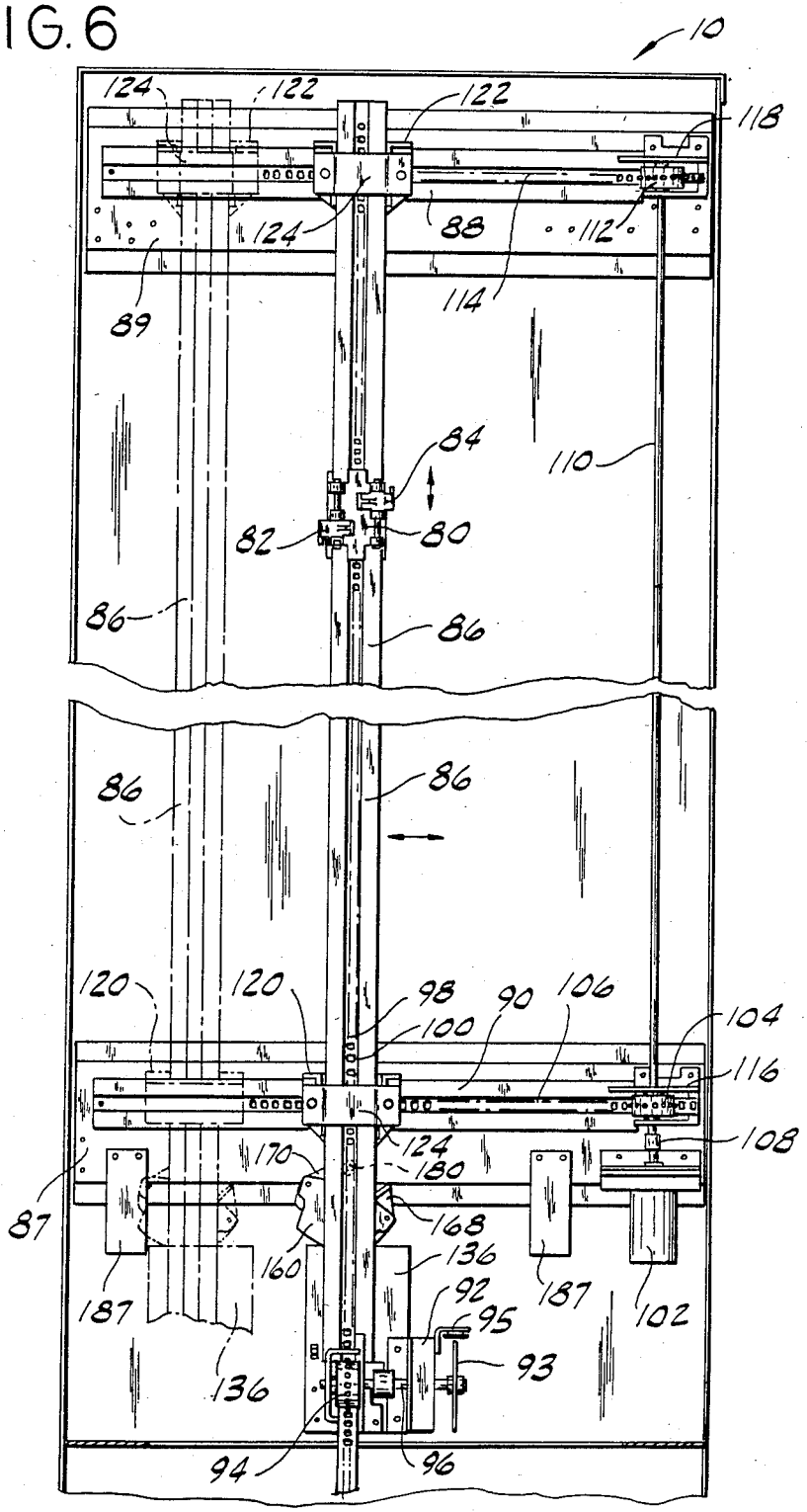
FIG. 6 is a side view similar to FIG. 5, but enlarged and viewed in the direction of line 6—6 on FIG. 2, illustrating in more detail one of the ejector mechanisms of the present invention and showing in phantom its lateral movement to a forward position.

Referring now to the ejector mechanism 40, there are two of them, one positioned on the right side and one on the left side of the banks 22 and 24 of magazines 26, as shown in FIGS. 3 and 4. The mechanisms 40 are mirror images of one another and, therefore, only one will be described in detail. As shown in FIG. 6, the ejector mechanism 40 generally consists of a slider 80 carrying a pair of ejectors 82 and 84. Slider 80 is mounted to a vertical support bar 86 for vertical up and down movement. Vertical support bar 86 is, in turn, supported for front and back movement relative to the cabinet, by a pair of stationary horizontal support bars 88 and 90 welded or otherwise mounted to support plates 87 and 89 which, in turn, are welded to the sides of the cabinet.

Vertical movement of slider 80 is controlled by a digitized motor 92 mounted to vertical support bar 86 for movement therewith, and which has a cogged wheel 94 mounted to its output shaft 96 which, through the cogs, engages a perforated tape 98 having equally spaced slots 100 defined therein matching the spacing of the cogs on the cogged wheel 94. Perforated tape 98 is preferably made of a plastic or other somewhat flexible material having adequate stiffness to move the slider 80 up or down to the desired vertical location and so that it is accurtely positioned adjacent a magazine 26 for subsequent ejection of a pack as described below.

Digitized motor 92 is utilized to keep continuous track of the vertical position of slider 80 on the vertical support bar 86 so that that position can be translated, via the microprocessor in the control circuitry, into a relative position with regard to the magazines 26 in order to be able to move the slider to a desired vertical location adjacent a magazine holding a customer's selection. The motor 92 includes a timing disk 93 which, in conjunction with a light source and photo sensor, housed at 95, form a vertical movement sensing device which in a conventional manner monitors the rotational position of the drive shaft of motor 92.

A similar arrangement is utilized to control the front and back movement of support bar 86 on the horizontal support bars 88 and 90, although the exactness of the position of slider 80 in the horizontal plane is not as great a concern as is the vertical position and, therefore, exact location of the vertical support bar 86 relative to the horizontal support bars 88 and 90 is not constantly monitored. On each side of the cabinet a motor 102 is utilized to drive a cogged wheel 104 which engages a perforated tape 106, formed the same as tape 98. In addition, the output shaft 108 of motor 102 is extended to the upper portion of the cabinet by rod 110 which is secured to the drive shaft 108 for rotation therewith and which has a further cogged wheel 112 secured thereto which engages a further perforated tape 114.

Motor 102 is stationary mounted to the side of the cabinet and cog wheels 104 and 112 are stationary mounted through respective brackets 116 and 118 for rotation on the rod 110. The vertical support bar 86 is secured to the perforated tapes 106 and 114 by brackets 120 and 122, respectively. Bracket 120 is shown in cross section in FIG. 9 as held rigid against the vertical support bar 86 by a U-shaped bracket 124 bolted to the bracket 120. The upper portion of bracket 120 forms a lip 126 which overhangs the contoured horizontal support bar 90 so that it will slide smoothly therealong as it is moved back and forth horizontally by the tape 106.

On the inner surface of bracket 120 are formed 3 cylindrical pegs 128 which are formed and spaced to fit into 3 sequential slots in perforated tape 106 so that there is very little relative movement between the tape 106 and bracket 120. Since the tape 106 is guided at its upper and lower edges in the channels 130 and 132 formed along the length of horizontal support bar 90, the pins 128 will remain engaged in the slots in which they are placed, during movement of the perforated tape 106. A lower confining lip 134 is formed on bracket 120 so that horizontal support bar 90 remains captive in the bracket 120 as the vertical support bar 86 is moved horizontally back and forth along the length of horizontal support bars 88 and 90. Bracket 122 is constructed identically to bracket 120 and is supported on horizontal support bar 88 and engages tape supporeted on horizontal support bar 88 and engages tape 114 in the same manner as bracket 120 is supported by bar 90 and engaged in tape 106. Vertical support bar 86 has a plate 136 mounted at its lower end for movement therewith and which carries the digitized motor 92.

As seen in FIG. 7, slider 80 is formed with two L-shaped ends 142 which grip the contoured shape of vertical support bar 86 and hold the slider 80 for vertical movement along support bar 86. Slider 80 is also provided with 3 cylindrical pins 144 (FIGS. 8 and 9) which are spaced to engage 3 adjacent slots in perforated tape 98 so that slider 80 is fixed to the tape for movement therewith. Tape 98 is contained within channels 141 and 143 formed in vertical support bar 86 (FIG. 7) which maintain the tape 98 flat for vertical up and down movement.

Each of the ejectors 82, 84 is pivotally mounted in its central portion by a pin 148 to a respective extension 150 formed in slider 80. As seen in FIG. 8, the pairs of ejectors 82, 84 mounted to a slider 80 are offset vertically and have pusher faces 152 facing but offset to one another, either of which can engage a pack of cigarettes positioned at the end of a magazine 26, depending on which direction horizontally the slider 80 carrying ejectors 82 is moved.

The opposite end from pusher face 152 of each ejector 82, 84 forms a stop 154 which engages the side of slider 80. The stop 154 is normally held against the side of slider 80 by a biasing spring 156 which has one of its outer end portions secured to a cylindrical extension 158 on each ejector 82, 84 and an opposite end portion engaging the surface of the slider 80 so that ejectors 82, 84 are normally held in the position shown in full line in FIG. 7.

As one of the ejectors passes through a slot 62 to force a pack of cigarettes 35 into delivery chute 64 the other ejector carried by slider 80 is folded against slider 80 by engagement with the vertical end plate adjacent the slot. As the slider 80 returns to the central position shown in full line in FIG. 7, the spring 156 extends the second ejector to the position shown.

Figure 11:
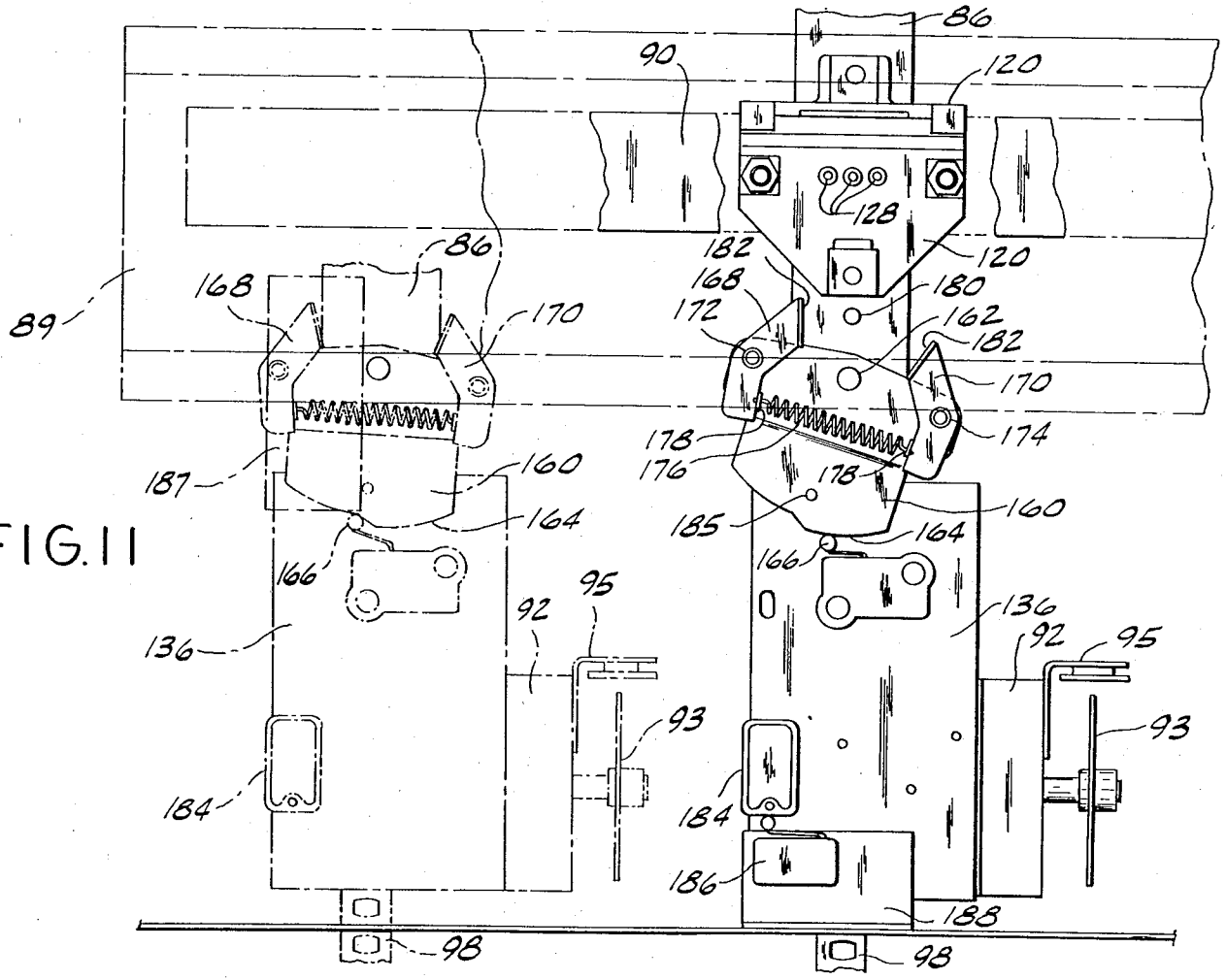
FIG. 11 is a view of the opposite side of the direction sensing mechanism illustrated in FIG. 10 as viewed from the right in FIG. 9.

A direction sensing and reversing device is illustrated in FIG. 11. This device is carried on the lower end of vertical support bar 86 and is electromechanical in nature. It includes a plate 160 which is pivotally mounted at a pin 162 secured to vertical support bar 86. The lower end of plate 160 forms a camming surface 164 which engages the microswitch 166 mounted to the mounting plate 136. Carried on plate 160 are a pair of trip arms 168 and 170 which are pivotally mounted by pins 172 and 174 to the mounting plate 160. A biasing spring 176 normally holds them in the position, relative to plate 160, as shown in FIG. 11, by biasing the stop ends 178 against the edges of plate 160. A pin 180 is fixed to the side of the cabinet and engages a face 182 of either of the trip arms 168, 170, depending upon the direction of movement of vertical support bar 86. Mounted to the lower edge of mounting plate 136 is a bracket 184 which, at the home position for vertical support bar 86 as shown in solid line in FIG. 11 and which corresponds to the position of the slider 80 as shown in the FIG. 3, engages a microswitch 186 stationarily mounted by bracket 188 to the base of the cabinet.

On bracket plate 160 is mounted a pin 185 which extends outwardly as shown in FIG. 11 to engage a reversing plate 187 positioned near the end of the bracket 89 as shown in phantom in FIG. 11 and another of which is positioned at the opposite end of the bracket 89 as seen in FIG. 6. These reversing plates 187 are engaged by the pin 185 as the direction sensing device moves in one direction or the other and causes the plate 160 to rotate about pin 162 thus causing the camming surface 164 to either open or close the microswitch 166 depending upon which direction the device is traveling, and thus cause the device to reverse its direction through input from the microswitch 166 through the microprocessor and to the horizontal drive motor thus causing it to reverse.

The direction sensing mechanism is utilized in case there is a power interruption to the equipment such that the machine control logic is wiped out. On restoration of power the position of the direction sensing mechanism will provide input to the machine control logic to indicate which direction the ejector mechanism was moving at the time power was interrupted and thus allow the logic circuit to determine whether or not further movement of the ejector mechanism is necessary. For example, if the power was interrupted in the middle of a vending cycle it may be necessary to continue movement of the ejector to dispense a pack from a magazine once power is restored.

Operation of the preferred embodiment is controlled through a microprocessor (such as a Motorola MC68705) and associated circuitry (FIG. 12) which interconnects the customer selection keyboard 14 and a credit register with the ejection mechanism so that the customer selection is delivered to the appropriate delivery station 20. The credit register is of conventional construction for determining the coinage or bills deposited in the coin receipt and acceptance mechanism 16 and determines how much change has been deposited and supplies this information to the microprocessor and logic in a well known manner.

Figure 12:
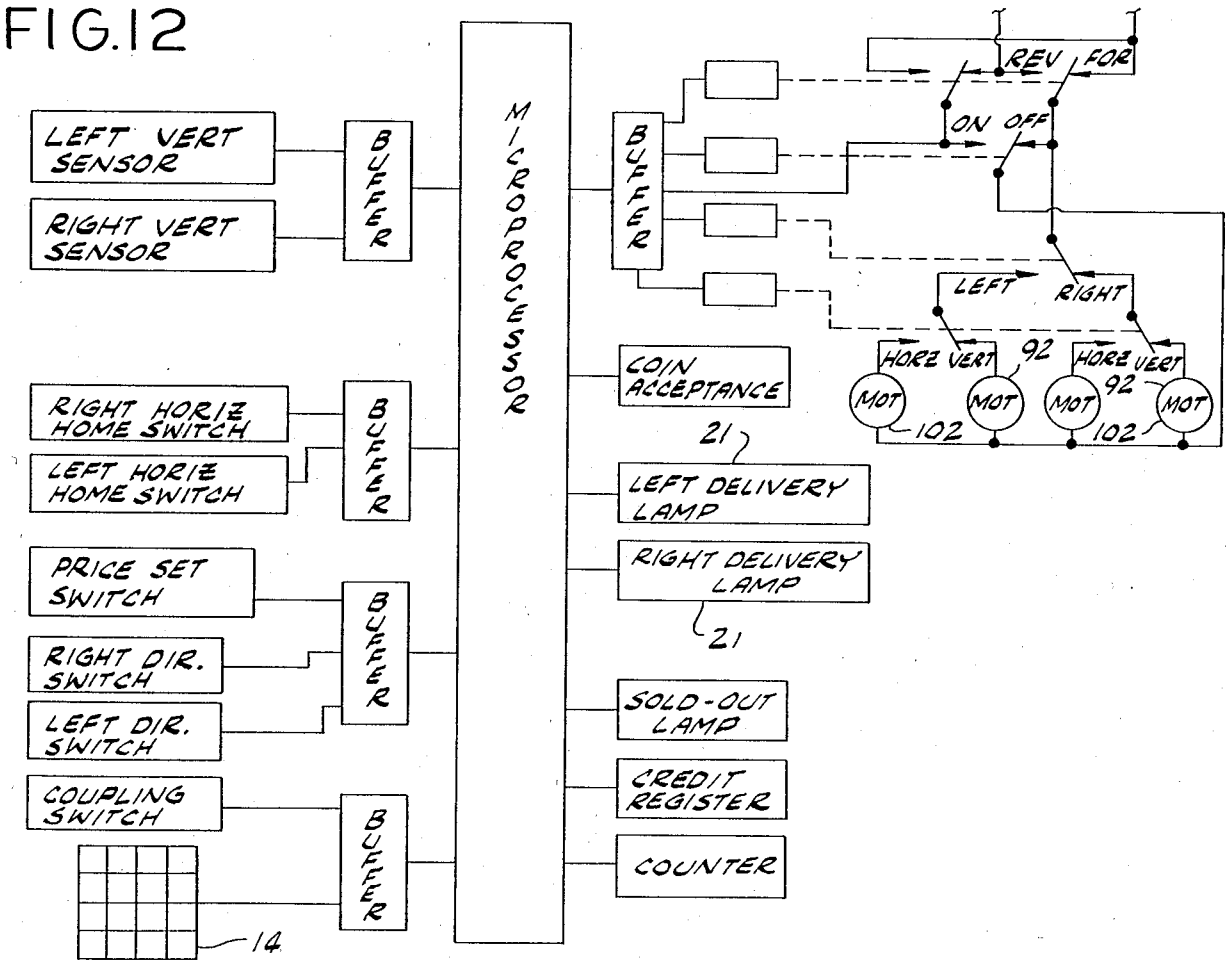
FIG. 12 is a schematic representation of the electronic control means of the present invention.

The left and right vertical sensors identified in FIG. 12 represent the output from the photosensors associated with the timing disks 93 of the left and right vertical drive motors 92. The left and right horizontal home switches are switches 186 which indicate that the vertical support bar 86 on the right or left side is in its horizontal home position between the right and left banks 22, 24 of magazines 26. The right and left direction switches referred to in FIG. 12 are the microswitches 166 for the left and right sides which indicate the direction of movement horizontally of the vertical support bar 86. The price set switch (not otherwise shown) is utilized to set the single price for all of the articles, such as cigarettes, which are contained in the magazines 26. The coupling switch (not otherwise shown) permits more than one shelf or magazine 26 to be loaded with the same brand of cigarettes and will produce alternating feed between the two shelves so that the volume of a single brand may be increased beyond that obtainable in a single magazine while requiring only the use of a single address code to produce the sequential ejection of packs of that brand of cigarettes from multiple locations. All of the above described sensors and switches are coupled to the microprocessor through appropriate buffer circuits to supply the information necessary to produce the desired outputs and control by the microprocessor.

The right and left delivery lamps 21 are associated with the two delivery stations 20 and are activated appropriately for delivery to either the right or left station depending upon whether the brand selected is from the right or left end of the magazines 26. The sold out lamp 15 is positioned adjacent the customer selection switches 14 so that if a selection is sold out the light is activated to indicate that that particular brand is sold out and another desired selection should be made or the coin return mechanism should be activated. A counter is provided to keep track of all articles vended from the machine for inventory purposes.

The microprocessor controls operation of each of the motors 92 and 102 for each of the left and right sides and through the circuit illustrated, runs the motors forward or reverse to move them to the appropriate location as determined by the programming of the microprocessor as discussed below and as illustrated in FIGS. 13*a–j*.

Figure 13A:
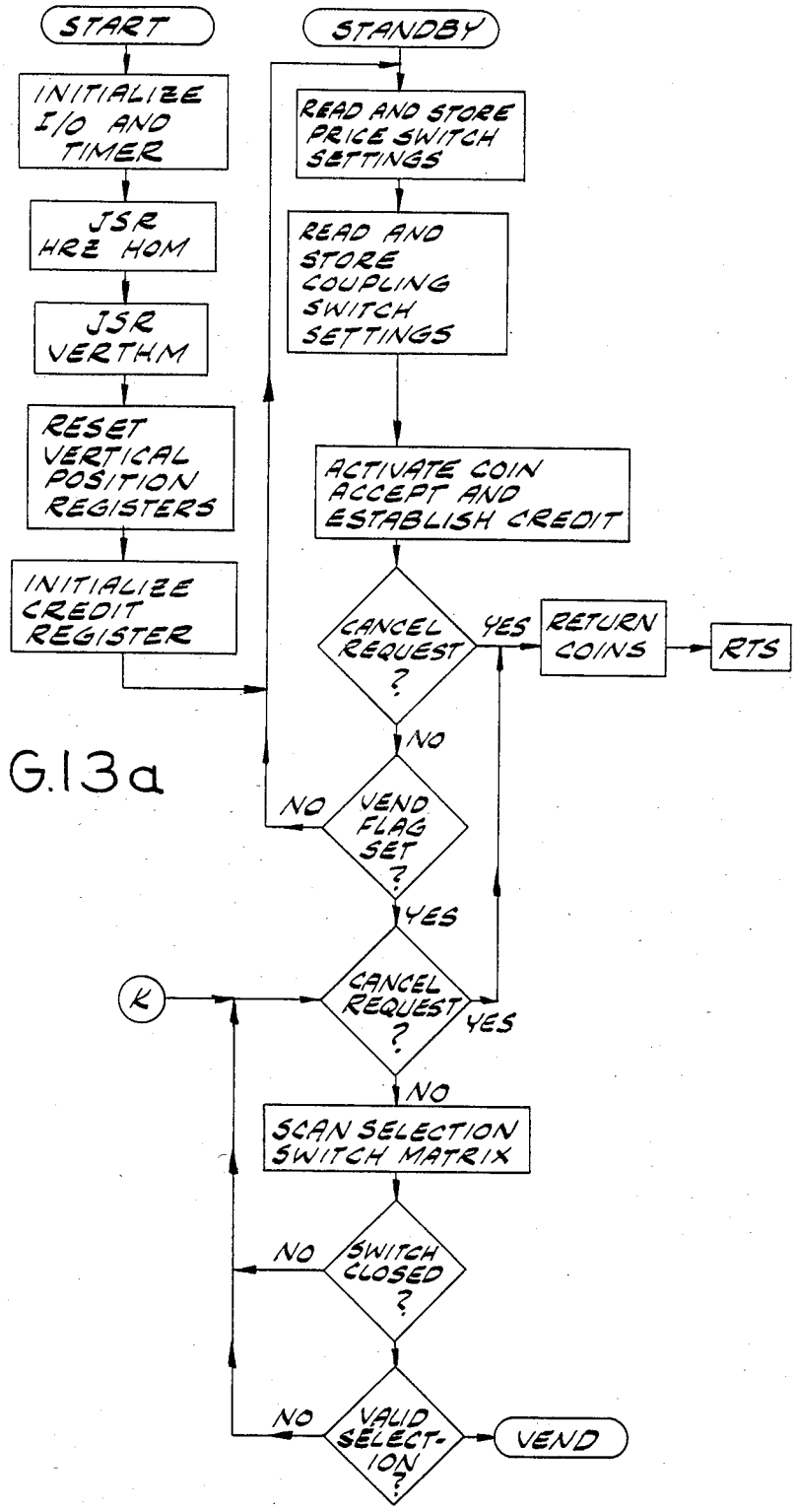
FIGS. 13*a–j* are block diagram flow charts of the control logic for the microprocessor which controls operation of the preferred embodiment of the present invention.
Figure 13B:
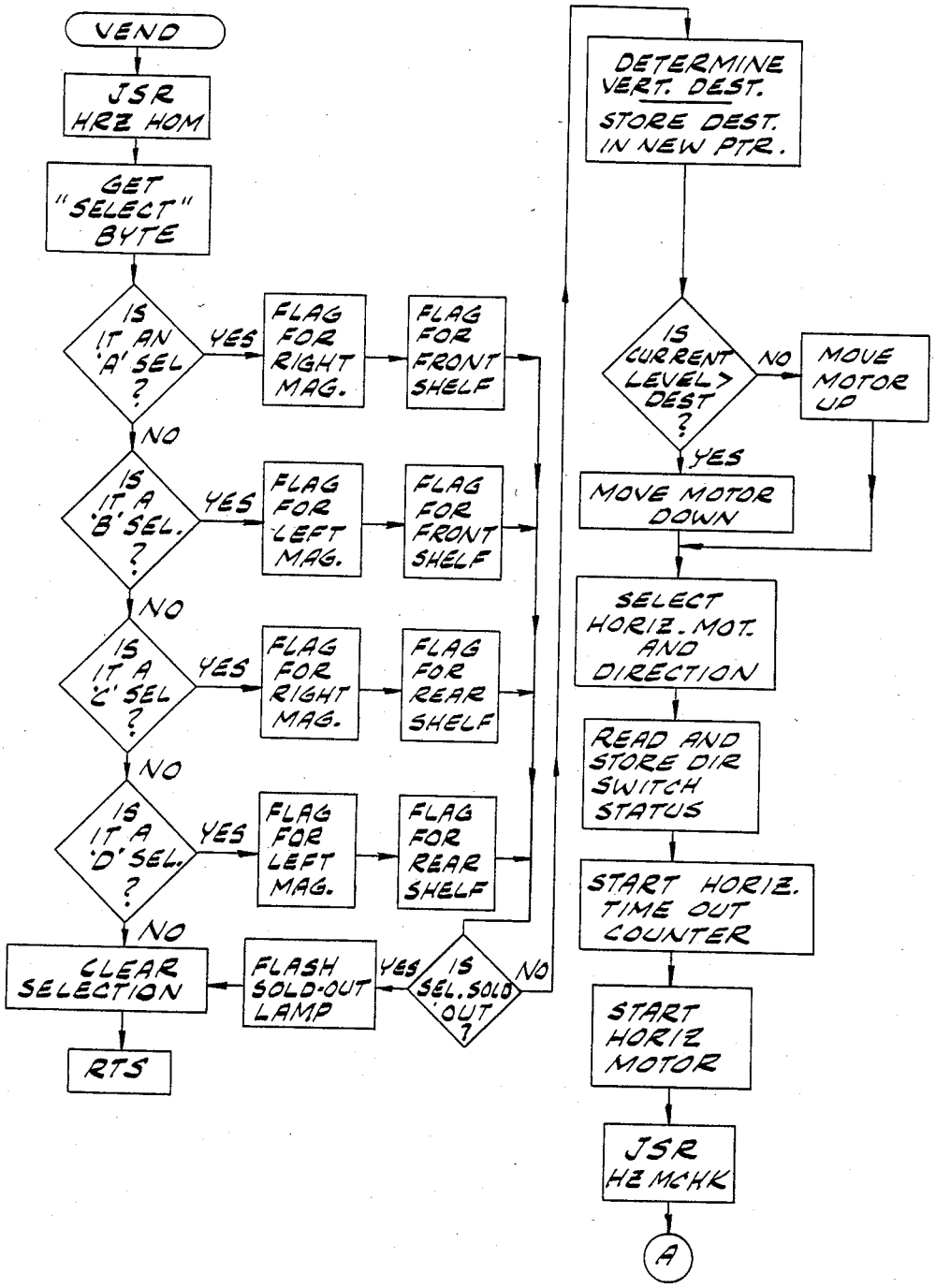

As shown in FIG. 13*a*, when power to the machine is initially turned on the microprocessor programming initializes the input/output and timer circuits and immediately jumps to the subroutine HRZHOM (Horizontal Home) the HRZHOM subroutine is illustrated in FIGS. 13*g* and *h*. In this subroutine the microprocessor enables the data section to read the status of the left and right home position switches 186 and direction switches 166 to determine the location of each of the ejector mechanisms.

Examination of the condition of switches 166 and 186 determines the position of the left and right vertical support bars 86 to establish whether or not they are already in the home position, i.e., positioned in the center between the front and rear banks of magazines, and if not, the microprocessor causes the motor 102 on the left or the right of the machine to turn in the proper direction in order to move the associated vertical support bar 86 towards the home position.

Included in the HRZHOM subroutine is the condition that if the vertical support bar 86 is not in the home position when the switches are initially interrogated, it will be moved in the same direction as the direction sensing mechanism indicates it was last moving before the power was turned on which, in the manner mentioned above in connection with FIG. 11, will cause the vertical support member to eventually reverse its direction and head for the home position. If interrogation of the right and left horizontal home switches indicates that either or both are not functional, the microprocessor will produce an illumination of the "sold out" sign on the selection board when any cigarettes are selected from whichever ends of the magazines are associated with the defective switches. Also, the microprocessor will not activate the motors at the end of the magazine where a malfunction is indicated, so that the ejector mechanism on that end will remain inoperative.

Figure 13C:
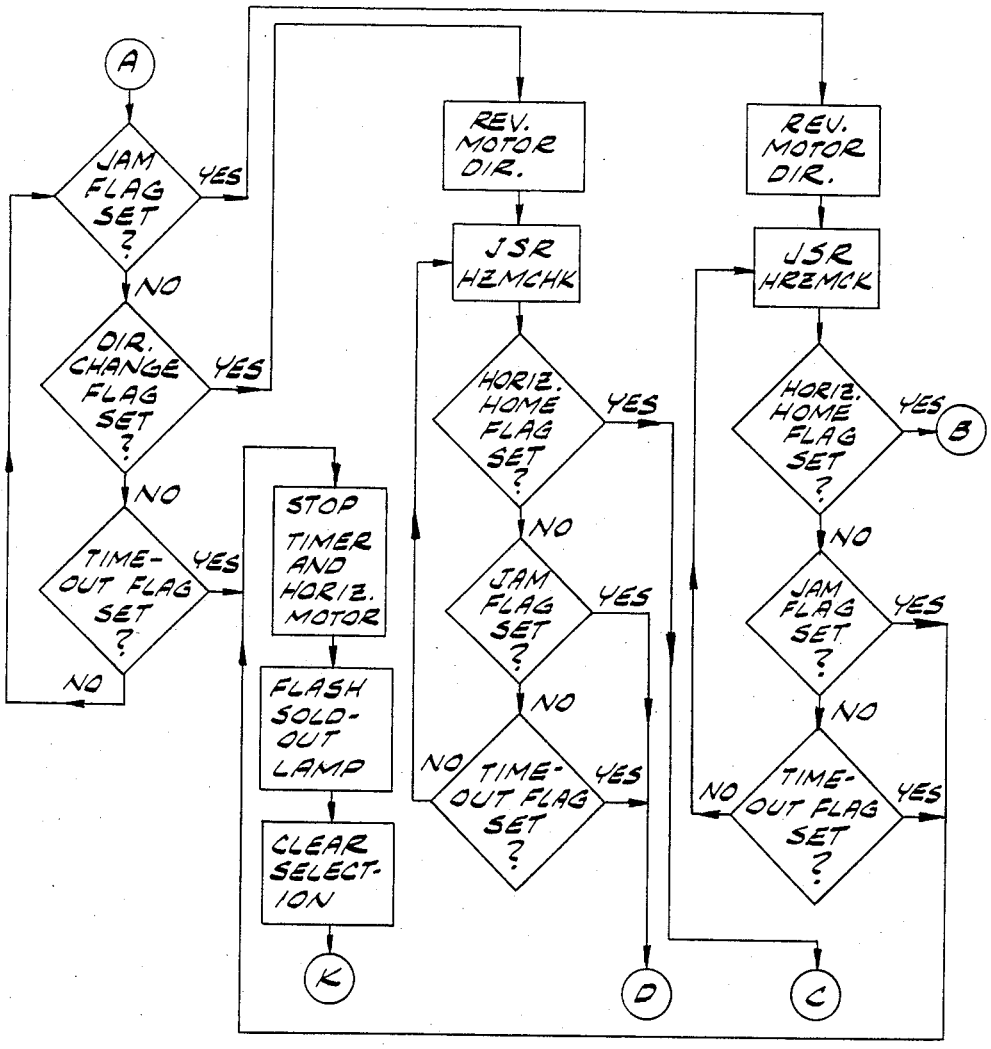
Figure 13D:
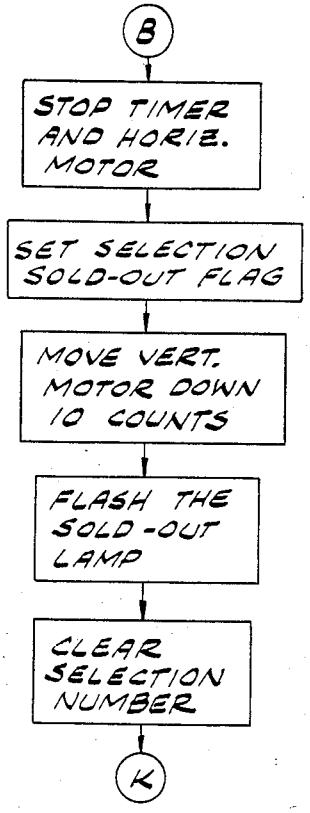
Figure 13E:
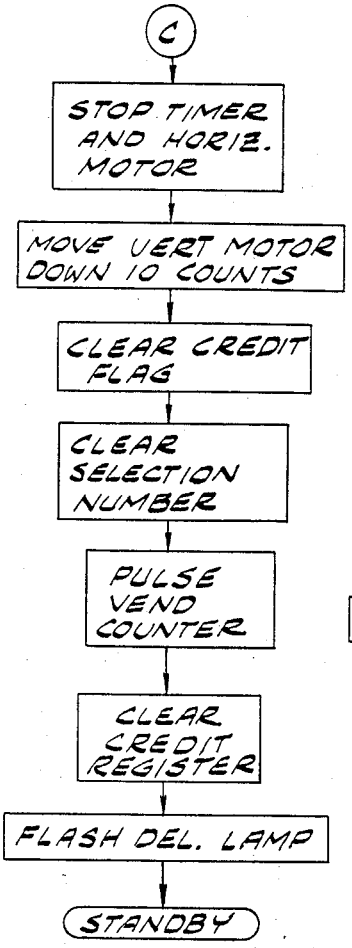
Figure 13F:
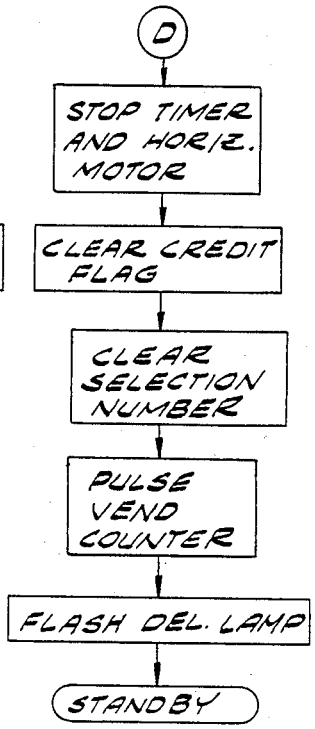
Figure 13Q:
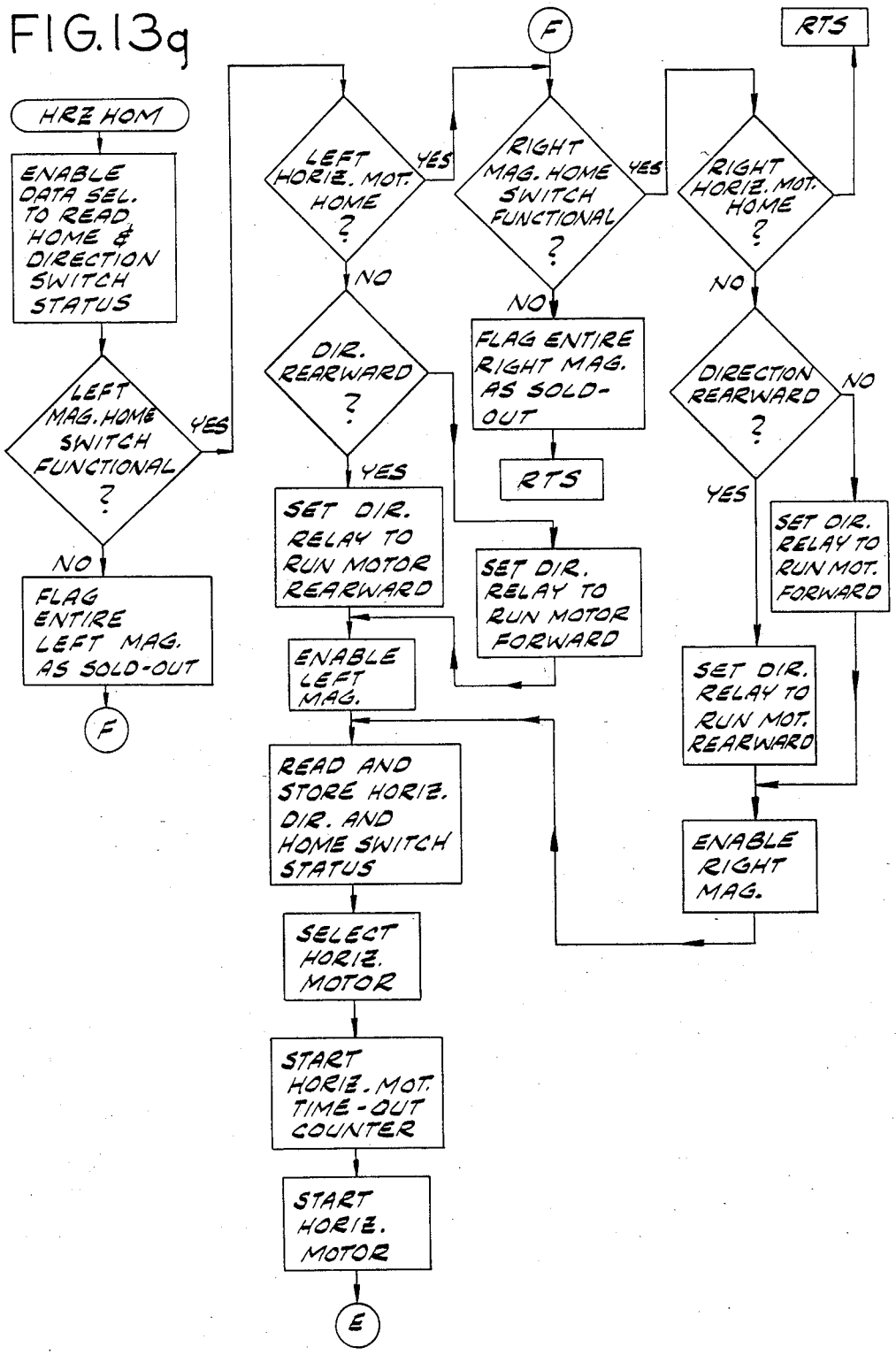
Figure 13H:
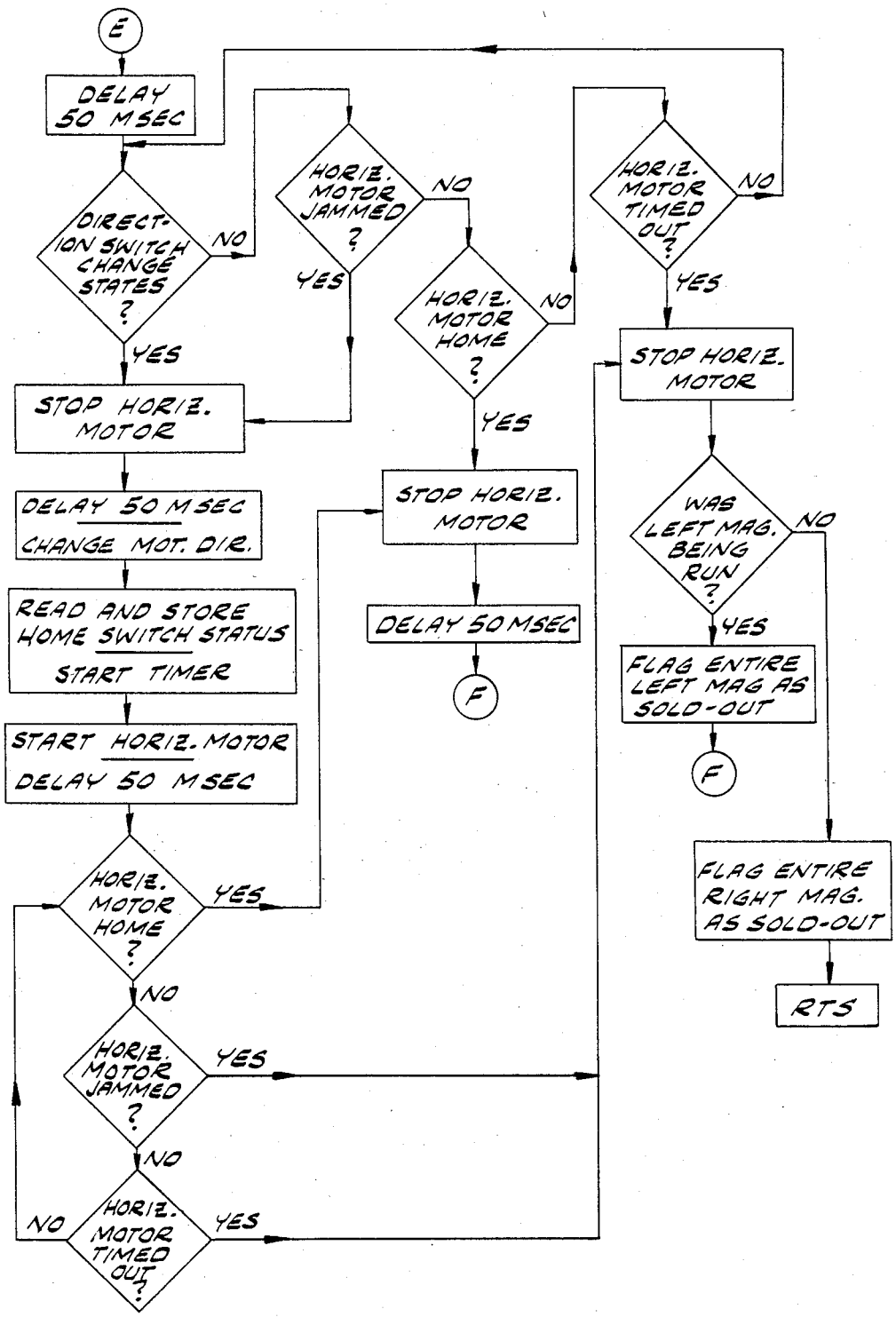
Figure 13I:
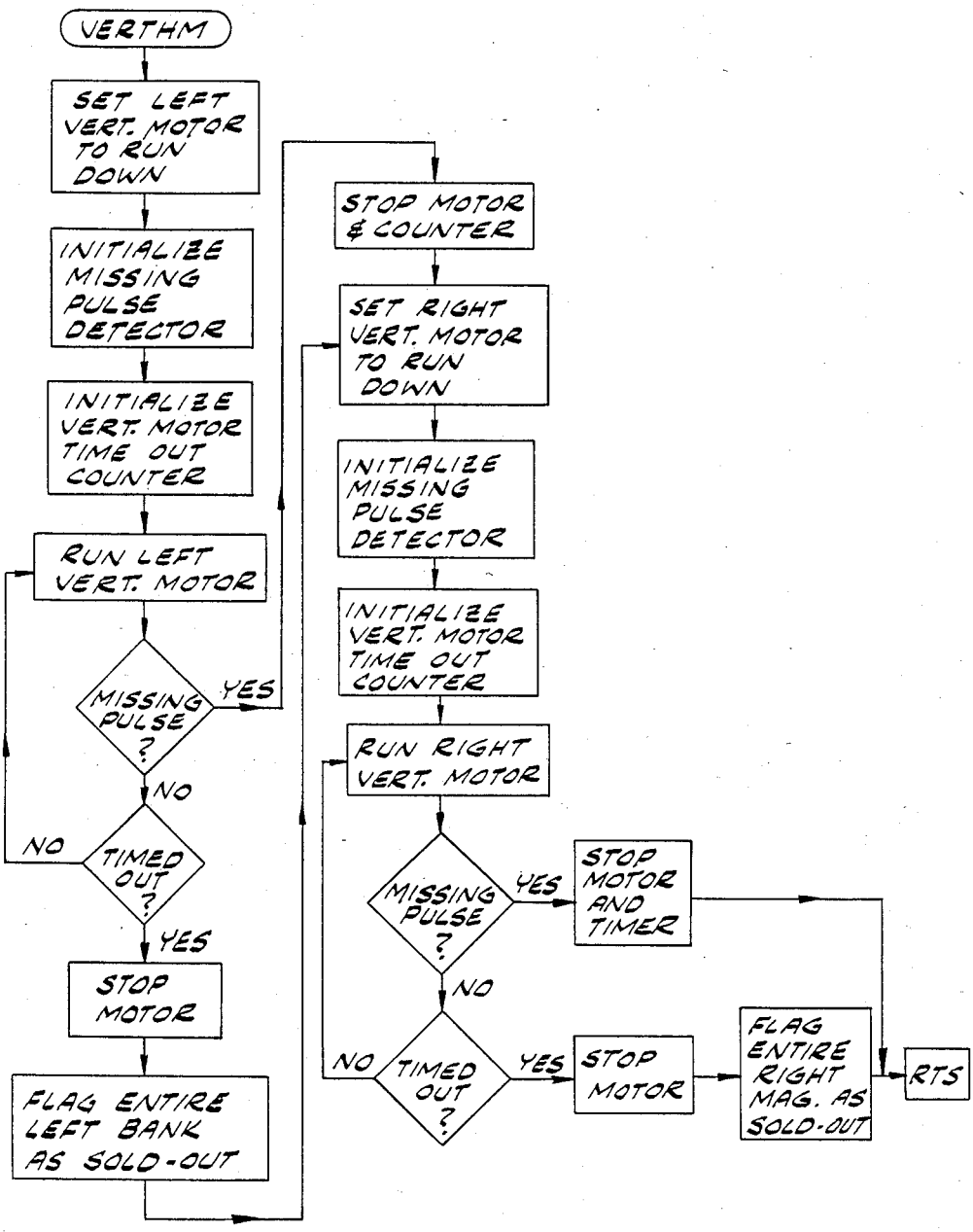

After running the HRZHOM subroutine the microprocessor returns to the main program illustrated in FIG. 13*a* which then causes it to jump to the VERTHM (vertical home) subroutine which is illustrated in FIG. 13*i*. This subroutine returns the slider 80 to the vertical home position resting against the upper surface of bracket 120 on either the left or right ejector mechanism. As with the HRZHOM subroutine, if a problem is encountered in returning the ejector mechanism to the vertical home position on either the right or the left bank, or both, the "sold out" light will be illuminated whenever a brand of cigarettes located at the end of a magazine where a malfunction is indicated is selected and the ejector drive motors for that side are disabled so that no selections are permitted on that side of the machine. In this subroutine the microprocessor monitors the input from the photo detector associated with the timing disk 93 to determine if the motor 92 is operating properly. If there is a missing input pulse from the detector the microprocessor attempts to correct the problem by operation of the steps shown in this subroutine and if it can't it shuts the side down.

After completion of the VERTHM subroutine the microprocessor returns again to the main program illustrated in FIG. 13*a* wherein it then resets the vertical position registers in its memory and initializes the credit register, i.e. resets it to zero, and then enters the standby mode.

In the standby mode, the microprocessor first reads and stores the price switch settings which, as previously mentioned, will be the same for each of the possible selections in the preferred embodiment, although multiple pricing for articles could be incorporated in the design if desired. It then reads and stores the coupling switch settings which indicate whether two magazines should be tied together by the microprocessor in order to provide additional volume for an individual brand of cigarettes by operating as a single expanded magazine.

At this point, the microprocessor will await input of change to the coin accept mechanism which, through well known technique, will provide pulses indicative of the type of coins being put in the coin acceptance mechanism and which will be passed by the microprocessor to the credit register to establish adequate credit. As credit is being established the microprocessor will check to see if the coin return switch has been activated and if it has will return any coins put in. Once adequate credit to make a purchase has been established it will again check the return switch and if it has been activated the microprocessor will cause the registered amount of credit to be returned and then return to the start of the program to begin again. If the coin return switch has not been activated and a valid selection has been made it will then check to see if it is permitted to make a vend or has been disabled through a flag established in one of the horizontal home or vertical home programs, or other sections of disabling instructions set out below, in case there is some malfunctioning in the equipment.

The microprocessor then scans the selection switch matrix of keyboard 14 to determine which selection has been made, if any. If there are no switches yet closed as it scans them it will return to monitor the coin return and continue in this loop until either the coin return is activated or a switch is activated.

If a switch is finally activated in this mode it will determine whether or not the selection is valid, i.e. whether or not it is for an address on the end of a magazine which will be permitted to vend or whether it is from a magazine which through the horizontal home and vertical home programs will not be accessed due to malfunction in the equipment. If it is a valid selection, microprocessor will enter the vend subroutine illustrated in FIG. 13*b*.

In the vend subroutine the microprocessor first again jumps to the HRZHOM subroutine and goes through the same steps previously indicated in that subroutine. Assuming that everything appears to be okay it will then return to the vend subroutine and next determine the location of the selection as a result of the input from the selection switchs. For example, it will first test to see if it is from an "A" selection, a "B" selection, a "C" selection or a "D" selection, each of which corresponds, respectively to a left rear, a left front, a right rear and a right front magazine. Once this is established, it will then check to see if an internal flag is set for whichever end of bank of magazines is being addressed which would prohibit a vend from that bank of magazines at that end.

If a flag is set, the "sold out" light will be flashed, the selection will be cleared from memory and the microprocessor will return to rescan the cancel request and selection switches to allow return of credit or an alternate selection. If no flag is set on the selected bank the microprocessor will then determine from the input information what the vertical destination is, i.e. which magazine the article selected is stored on. It then checks its memory with respect to the current position of the vertical drive motor which controls the ejector mechanism associated with that bank to determine if it is above the level of the desired destination. If it is not, it will activate the vertical motor for that side to move the ejector mechanism up to the appropriate level adjacent the selected magazine. If it is already above the current level of the intended destination of the ejector mechanism it will move the motor down to the appropriate level. The microprocessor then selects the appropriate horizontal drive motor and the appropriate direction, i.e. forward or rearward, to eject the selected article from the magazine. It then reads and stores the current position of the direction switch and starts the appropriate horizontal motor movement after a selected delay time to cause a vend of the selected article.

Figure 13J:
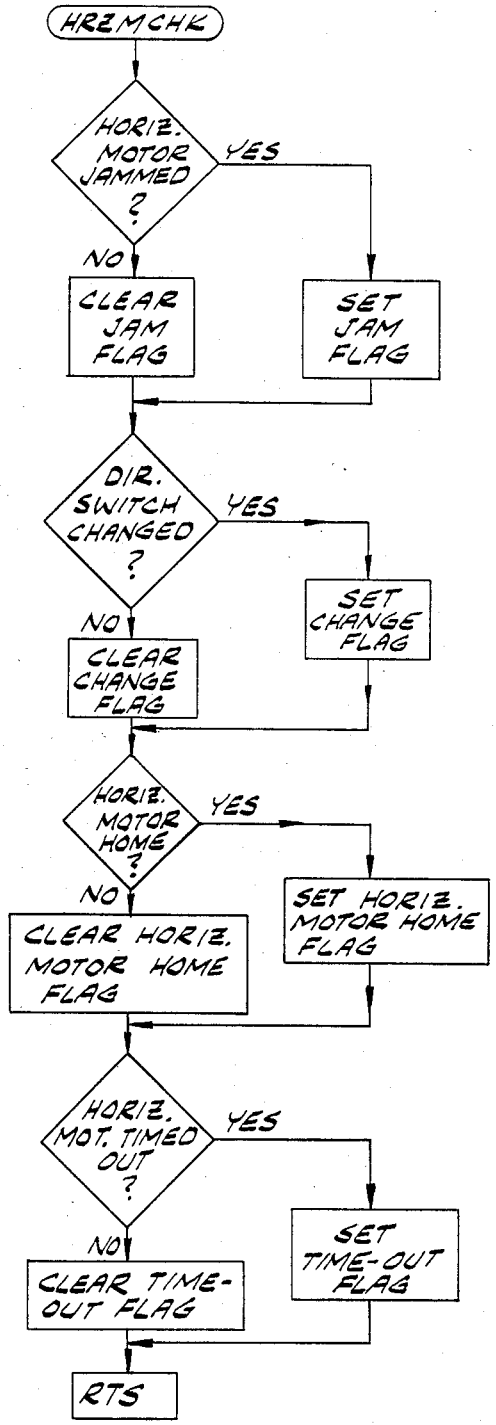

After it enables the appropriate horizontal motor, it jumps to the HZMCHK (horizontal motor check) subroutine illustrated in FIG. 13*j* wherein it monitors whether or not the horizontal motor is indicating a jammed condition. This will occur when an article selected has previously been sold out and the horizontal motor causes the ejector to strike the member 36 and be stopped. A jam is indicated by an increase in current to the motor since it is stalled against the member 36. When this condition is sensed this subroutine causes the motor to reverse direction to go to the horizontal home position. Once this has occurred at a particular address that information is stored in memory and that address is flagged so that subsequent attempts at selecting that address will be indicated immediately as sold out and the ejection mechanism will not be enabled. After these checks have been made in the HZMCHK subroutine and the appropriate flags set set or cleared, the microprocessor returns to the vend subroutine at point A on FIG. 13*c*.

In addition to sensing an increase in motor current when a selection is sold out, as a backup, a timer is monitored which is set to permit a reasonable time of operation for ejecting an article at a magazine location, after which time it is assumed that a malfunction of some sort has occurred which causes the mircoprocessor to stop the horizontal motor being run and flash the sold out lamp and clear the selection, it then returns through point K to the subroutine of FIG. 13*a* where it monitors the selection switches to determine if another selection has been made or if the customer has requested a return of his change by operating the coin return mechanism.

Referring again to FIG. 13*c*, if the direction change flag is set the HZMCHK subroutine is again checked after which it determines whether or not the horizontal home flag was set and if it was, moves to point C to the subroutine of FIG. 13*e* wherein it stops the timer and the horizontal motor and then activates the motor to move the slider 80 down for 10 pulses of the detector associated with the timing disc. This offsets the ejectors from any magazine as a security measure to prevent someone from manually moving the vertical support bar back and forth to cause the ejector mechanism to empty a magazine which it sets adjacent to when dormant. The Microprocessor then cleans up the various memories by clearing the credit and the selection address and then indicates that a selection has been made and stores it in the counter, flashes the delivery lamp above the appropriate delivery station 20 on the left or the right side of the machine depending upon where the selection will come out, dump money from the acceptance mechanism into a cash box (not shown) and then returns to the standby position in the program.

Referring again to the subroutine of FIG. 13*c* if the horizontal home flag is not set it then determines whether or not the jam flag or the time out flags are set and, if so, goes to subroutine of FIG. 13*f* where it goes through the same set of instructions as in FIG. 13*e*. If not, it reenters the HZMCHK subroutine then returns or is sent to another subroutine as indicated.

At the point "A" of entering the program of FIG. 13*c* the microprocessor determines whether or not a jam flag has been set and if it has it reverses the motor direction and then goes to the subroutine HZMCHK and upon return therefrom determines whether or not a horizontal home flag was set and, if so, goes to the subroutine B of FIG. 13*d* where it stops the timer and horizontal motor being run, sets the selection flag as sold out, moves the vertical drive motor down 10 counts, flashes the "sold out" lamp and clears the selection and returns to the point K of the subroutine of FIG. 13*a* in a ready condition for a further selection or return of the credit established. Referring again to FIG. 13*c* if upon examining the horizontal home flag it is not set, it determines if there is a jam flag set or a time out flag set and, if so, it stops the timer and the horizontal motor being run, flashes the "sold out" lamp, clears the selection and also returns to point K of FIG. 13*a* in a ready condition.

Thus, it can be seen that through opeation of the microprocessor the making of a selection by a customer through input on the keyboard 14 causes the appropriate ejector to move to the address of the desired selection and to eject the same for delivery to the appropriate delivery station. Also, the microprocessor constantly monitors the functional condition of the motors and the various position and direction switches to make sure that the machine is operational and, if not, shuts down that portion of it which is not functioning to prevent damage to the equipment or erroneous vending of articles from magazines.

In view of the above, it will be seen that the several objects of the invention are achieved and other advantageous results attained.

As various changes could be made in the above apparatus without departing from the scope of tne invention, it is intended that all matter contained in the above description or shown in the accompanying drawings shall be interpreted as illustrative and not in a limiting sense.

What is claimed is:

1. An article vendor comprising:

a cabinet;

at least one bank of article holding magazines contained within said cabinet;

said bank comprising a plurality of horizontally disposed magazines each adapted to hold one group of laterally disposed articles to be vended individually from one end thereof and a second group of laterally disposed articles to be vended from another end thereof;

means for biasing each group of articles toward their respective ends of each magazine; and means for selectively dispensing the end articles at each end of each magazine.

2. An article vendor as defined in claim 1 wherein said means for biasing said groups of articles towards their respective ends on each magazine provides variable capacity for each group of articles on each magazine with the capacity being extendable beyond half of the total capacity of a magazine.

3. An article vendor comprising:

a cabinet having a front and a rear, and left and right sides;

front and rear banks of article holding magazines in the cabinet;

each bank comprising a plurality of said magazines extending horizontally one above another from adjacent a left side of the cabinet to adjacent a right side of the cabinet;

each magazine being adapted to hold articles to be vended in a first horizontal row for being dispensed from a left end of the magazine and in a second horizontal row for being dispensed from a right end of the magazine;

each magazine in the front bank being constructed for ejection of articles at the left and right ends thereof toward the front;

each magazine in the rear bank being constructed for ejection of articles at the left and right ends thereof toward the rear;

means for biasing each row of articles in each magazine toward the respective ends of the magazine;

means at the left end of the banks for selectively dispensing the end articles in the magazines at the left end thereof, and means at the right end of the banks for selectively dispensing the end articles in the magazines at the right end thereof.

4. An article vendor as set forth in claim 3 wherein the dispensing means at each of the left and right ends comprises ejector means movable up and down to the level of a magazine holding a selected article, to eject the selected article forward from a magazine in the front bank or rearward from a magazine in the rear bank.

5. An article vendor as set forth in claim 4, including electronic control means having manually operable control means for selecting a desired article, programmable memory means for knowing addresses of all left and right ends of the magazines and which articles are stored there, means for controlling movement of the ejector means for moving it to an address of a selected article and causing it to move forward to eject a selected article from a magazine in the front bank or rearward to eject a selected article from a magazine in the rear bank.

6. An article vendor as set forth in claim 3 wherein the biasing means comprises a pair of slide members movably mounted to each magazine and a pair of constant force springs one each associated with a respective one of the slide members so as to urge the slide members toward opposite ends of the magazine.

7. An article vendor, comprising:

a cabinet having a front, a rear and left and right sides;

a plurality of vertically stacked horizontal magazines mounted in the cabinet and forming at least two banks of magazines each extending across the cabinet from the right to the left side, each magazine being formed for horizontal discharge from at least one end portion thereof of articles disposed thereon, and means for urging the articles towards the at least one end portion, the magazines having means at the at least one end portion of each magazine for preventing the articles from being expelled from the magazines solely by the urging means;

ejection means mounted for vertical and horizontal movement adjacent the at least one end portions of the magazines and engagable with a selected one of the articles located at one of the at least one end portions of one of the magazines for laterally urging the selected article off of said one magazine;

article delivery means including at least one delivery pan from which an article can be retrieved and means disposed beneath the at least one end portion of a lowermost of the magazines in each bank for catching the articles as they are urged off of the magazines and delivering them to the delivery pan; and electronic control means having manually operable control means for selecting a desired article, programmable memory means for knowing addresses of all at least one end portions of the magazines and which articles are disposed at each address, means for controlling movement of the article ejection means for moving it to an address of a selected article so as to urge the selected article off of the magazine on which the selected article is sitting.

8. An article vendor as defined in claim 7, wherein the article delivery means includes a chute disposed beneath the at least one end portions of the lowermost magazines, the cabinet front defining an opening adjacent said delivery pan to which the chute directs an article removed from a magazine.

9. An article vendor as defined in claim 7 wherein the means for urging the articles towards the at least one end portions of the magazines comprises at least one slider movably mounted to each magazine and a constant force spring urging each slider toward a respective end portion of each magazine.

10. An article vendor as defined in claim 7 wherein the article ejection means comprises:

at least one ejector extending into the space between the banks of magazines;

means carrying the at least one ejector for vertical movement in the space between the banks of magazines;

means carrying the at least one ejector for horizontal movement adjacent the at least one end portions of the magazines in the banks so as to cause the at least one ejector to engage an article disposed in an end portion of anyone of the magazines which it moves adjacent to when properly aligned therewith by the means carrying the ejector for vertical movement.

11. An article vendor as defined in claim 10 wherein the at least one ejector includes a pair of vertically offset ejector members horizontally pivotally mounted to each ejector member carrying means for horizontal movement thereof, and stop means is provided for each ejector member for stopping pivotal movement of an ejector member when it is engaging an article on a magazine for removal thereof and allowing pivoting of an ejector member out of the way of a magazine from which an article is being removed by another ejector member of the pair.

12. An article vendor as defined in claim 7 including means for sensing the horizontal direction of movement of the ejection means so as to provide to the electronic control means an indication of which direction the ejection means was last moving should there be an interruption of power to the electronic control means.

13. An article vendor, comprising:

a cabinet having a front, a rear and right and left sides;

a plurality of vertically stacked horizontal magazines mounted in the cabinet and forming two laterally spaced vertical banks extending from the right to the left side of the cabinet, each magazine being formed for horizontal discharge from both end portions thereof of articles disposed thereon, and means for urging different ones of the articles towards both end portions, the magazines having means at both end portions of each magazine for preventing the article from being expelled from the magazines solely by the urging means;

article ejection means mounted for vertical and horizontal movement across the magazines adjacent said both end portions of the magazines and engagable with a selected one of the articles located at one of the end portions of one of the magazines for laterally urging the selected article off of said one magazine;

article delivery means disposed beneath said both end portions of a lowermost of the magazines in each bank for catching the articles as they are urged off of the magazines and delivering them to a predetermined location, and electronic control means having a manually operable control means for selecting a desired article, programmable control means for knowing addresses of all end portions of the magazines and which articles are disposed at each address, means for controlling movement of the article ejection means for moving it to an address of a selected article so as to urge the selected article off of a one of the magazines on which the selected article is disposed.

14. An article vendor as defined in claim 13, wherein the article delivery means comprises two separate delivery pans from which an article can be retrieved and two separate chutes one each disposed beneath respective lower most magazines in each of the two banks and associated with a respective delivery pan, said cabinet defining an opening adjacent each delivery pan.

15. An article vendor as defined in claim 13 wherein means for urging the article towards each end portion of one of the magazines comprises two sliders movably mounted to each magazine and two constant force springs, one urging each slider toward a respective end portion of each magazine.

16. An article vendor as defined in claim 13 wherein the article ejection means comprises:

a pair of ejector members extending into the space between the banks of magazines at each end of the banks;

means carrying the pair of ejector members for vertical movement in the space between the banks of magazines;

means carrying the pair of ejector members for horizontal movement adjacent the end portions of the magazines in the banks so as to cause one of the pair of ejector members to engage an article disposed in an end portion of any one of the magazines which it moves adjacent to when properly aligned therewith by the means carrying the pair of ejector members for vertical movement.

17. An article vendor as defined in claim 16 wherein the pair of ejector members are vertically offset and horizontally pivotally mounted to each ejector member carrying means for horizontal movement thereof, and stop means is provided for each ejector member for stopping pivotal movement of an ejector member when it is engaging an article on a magazine for removal thereof and allowing pivoting of an ejector member out of the way of a magazine from which an article is being removed by another ejector member of the pair.

* * * * *